US005566935A

United States Patent [19]

Meharg

[11] Patent Number: 5,566,935

[45] Date of Patent: Oct. 22, 1996

[54] BATTER DUMMY FOR PITCHING PRACTICE

[76] Inventor: Stephen W. Meharg, 9869 Curries Crossing, Jonesboro, Ga. 30236

[21] Appl. No.: 621,346

[22] Filed: Mar. 25, 1996

[51] Int. Cl.[6] ..... A63B 69/40

[52] U.S. Cl. ..... 273/26 A

[58] Field of Search ..... 273/26 A, 26 R, 273/29 A

[56] References Cited

U.S. PATENT DOCUMENTS

| | | | |
|---|---|---|---|
| 884,462 | 4/1908 | Briant | 273/26 A |
| 2,633,909 | 1/1972 | Doynow | 273/26 A |
| 3,163,419 | 12/1964 | Lemelson | 273/26 A |
| 3,658,329 | 4/1972 | Ciccarello | 273/26 A |
| 3,871,647 | 3/1975 | Tellez | 273/26 A |

*Primary Examiner*—Theatrice Brown
*Attorney, Agent, or Firm*—James B. Middleton

[57] ABSTRACT

A practice device to practice baseball pitching has a home plate, and a batter dummy adjacent to the home plate so the pitcher can get accustomed to the presence of a batter. The batter dummy has marks to indicate the strike zone. The batter dummy can be shortened or lengthened to suit the pitcher and to give wide experience. The dummy is inflatable for light weight and ease of installation; and, the dummy has three separately inflatable compartments so only a portion of the dummy must be inflated at one time. Portions of the dummy have accordion folded sections to change the length, and a strap to fix the length of the accordion folded section. The dummy is fixed to a mat by hook and loop fasteners, so the dummy can be placed as desired for training, the mat including the simulation of home plate.

8 Claims, 1 Drawing Sheet

BATTER DUMMY FOR PITCHING PRACTICE

BACKGROUND OF THE INVENTION

1. Field of the Invention

This invention relates generally to baseball practice apparatus, and is more particularly concerned with a dummy batter for use in pitching practice.

2. Discussion of the Prior Art

When a person is practicing pitching a baseball or the like, it is common to have a target for the person to hit. In the case of baseball, the "target" to be hit is the area designated as the "strike zone" by the rules of baseball. While a target can be prepared designating i a given rectangle as the strike zone, in a real game the strike zone is determined in relation to the batter and the home plate. As a result, the use of a printed target for pitching practice is not the best training for a pitcher.

Since the batter is part of the determination of the strike zone, a batter can be used effectively during pitching practice. A live batter would hardly endure such practice sessions, so it has been suggested that a dummy batter be used. A dummy for such a purpose is disclosed in U.S. Pat. No. 3,871,647. That dummy can be varied in height, and can be placed as desired with respect to a home plate. However, the apparatus disclosed in U.S. Pat. No. 3,871,647 is expensive to build, and cumbersome to move and to store. The device is designed to use in combination with an existing home plate, so pitching practice can be only on a baseball field.

SUMMARY OF THE INVENTION

The present invention provides an inflatable batter dummy having extendible portions so the height of the dummy can be varied as desired. The dummy is provided with a mat to which the dummy is selectively attachable, the mat including a design of a home plate. Further the dummy includes easily visible markers to show the upper and lower limits of the strike zone.

In the preferred embodiment of the invention, the dummy is divided into a plurality of sections that are separately inflatable. As a result, individual portions can be tested for leaks, or only one portion can be deflated and re-inflated when changing the height of the dummy.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
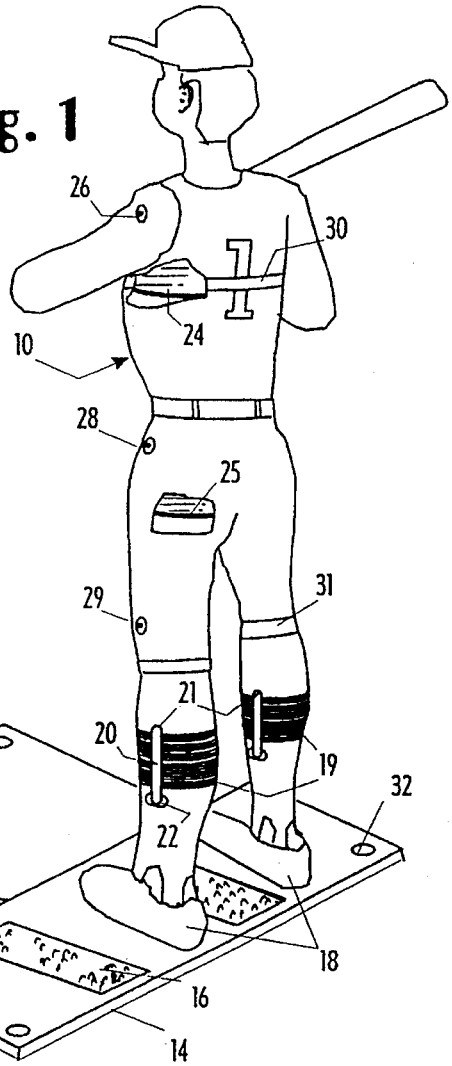
FIG. 1 is a perspective view showing a dummy made in accordance with the present invention, and including a mat for receiving the dummy.

Referring now more particularly to the drawings, and to that embodiment of the invention here presented by way of illustration, FIG. 1 shows a batter dummy 10 mounted on a mat generally designated at 11. The mat 11 includes a depiction of home plate at 12, and a dummy platform 14 for receiving the dummy 10. The dummy platform 14 may be temporarily or permanently fixed to the home plate by strips such as the strip 15. Those skilled in the art will understand that the strip 15 may be fixed to the mat 11 by hook and loop fasteners, pressure sensitive adhesive, or even permanent glue, heat sealing or the like. It may be convenient to separate the dummy platform 14 from the rest of the mat 11, for example to reverse the mat for a left-handed batter dummy; but, there are many situations in which a permanent connection may be desirable.

Figure 3:
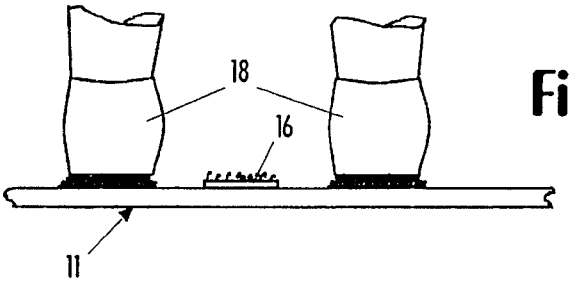
FIG. 3 is a fragmentary, rear elevational view showing the attachment of the dummy to the mat; and, FIG. 4 is an enlarged cross-sectional view taken along the line 4—4 in FIG. 1.

The dummy platform 14 is here shown as including a plurality of areas 16 for receiving the feet 18 of the dummy 10. It is contemplated that the areas 16 will comprise hook material of hook and loop fastener but, again, those skilled in the art will realize that other fastening means may be utilized. If the areas 16 are hook material, the bottoms of the feet 18 will include loop material as shown in FIG. 3. The feet 18 can therefore be placed anywhere described so long as a significant portion of the feet 18 engage areas 16. It will of course be understood that the entire platform 14 may be covered in hook material, so the feet 18 could be placed anywhere on the platform.

Looking at the area of the dummy 10 representing the calves of the legs, it will be noticed that there is an accordion section designated at 19. A strap 20 is fixed above the section 19 at 21, and is selectively fixable below the section 19 as at 22. It will also De noticed that the two legs have sections 19 that are alike, so only one section 19 will be described in detail.

Figure 2:
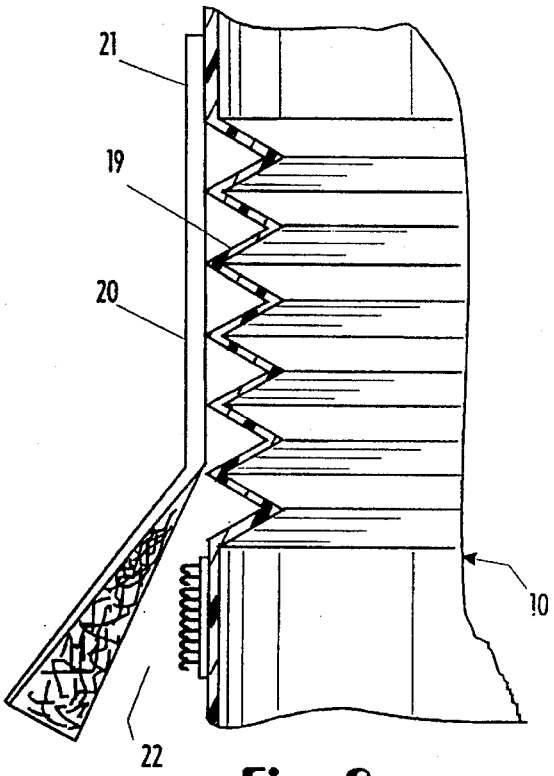
FIG. 2 is an enlarged, fragmentary view showing the means for changing the height of the dummy shown in FIG. 1.

With attention to FIG. 2 of the drawings, it will be seen that the section 19 comprises an accordion-folded section of the dummy 10. Thus, if the accordion pleats are gathered together, the dummy 10 will be shorter, and if the pleats are allowed to expand to their maximum, the dummy will be taller. The height is controlled by the strap 20 which is permanently fixed to the dummy at 21, and is temporarily fixed to the dummy at 22. The temporary fastening means here shown is a hook and loop fastener, but other fastening means may be used.

While the only expandable sections here shown are the sections 19 in the legs of the dummy, those skilled in the art will realize that the same arrangement can be provided elsewhere in the dummy. For example, the waist and/or chest may be expandable for varying the proportions of the batter. The construction would be precisely as shown in FIG. 2, and the operation would be the same.

It will be recognized that, if the inflatable dummy 10 has a leak, it would be very difficult to locate the leak in the large expanse of the dummy 10. To render this somewhat easier, the dummy 10 is divided into a plurality of compartments so a leak is confined to only one portion of the entire dummy 10. There is a generally horizontal divider 24, here shown as in the chest area of the dummy 10. Another divider 25 is in the area of the hips. Thus, the upper portion of the dummy 10 is one compartment which includes a fill valve 26. The central portion between the dividers 24 and 25 is a second compartment having a fill valve 28. The lower portion of the dummy 10, below the divider 25, is a third compartment with a fill valve 29.

The division of the dummy into a plurality of separate compartments will make finding a leak less burdensome, and will make filing and setting-up a little easier. Also, if the height is to be changed, the pressure in only one compartment can be reduced while the desired adjustments are made via straps 20.

Looking at the dummy 10 as a whole, there are stripes 30 and 31 for designating the upper and lower extremities of the strike zone. A new pitcher is usually instructed to throw the ball between the chest and knees of the batter. Both these terms may be vague when viewing a fully clothed person. The present invention therefore has stripes 30 and 31, preferably of fluorescent colors, to train the pitcher to look at the body of the batter and determine the strike zone.

Figure 4:
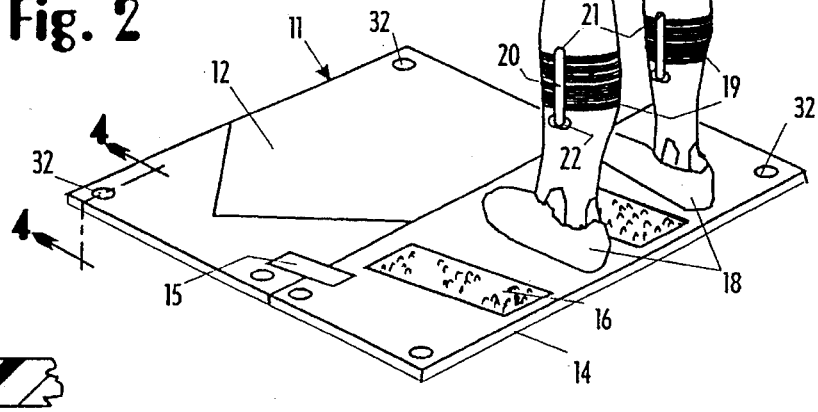
Figure 4:
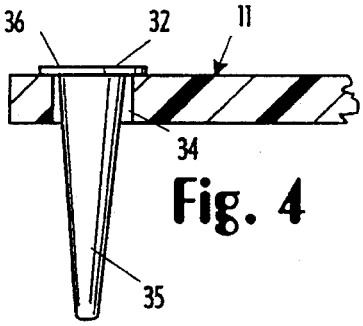

It is contemplated that the mat 11 will be formed of relatively thin material, preferably plastic sheet or the like. To secure the mat in position there are stakes, or nails, 32 as shown in detail in FIG. 4. In FIG. 4 it can be seen that the mat 11 defines a hole 34 therethrough, and the stake 32 comprises a shank 35 having a head 36. The shank 35 may be somewhat blunt for greater safety.

From the foregoing description it will be understood that the dummy of the present invention is admirably suited to practice for pitching baseball or softball. The dummy may be used with a fixed target, or with a person acting as catcher. Regardless of the practice situation, the dummy 10 will provide a semblance of a batter so the pitcher can become accustomed to the presence of a batter, and can judge the ball is thrown in relation to the batter and the home plate. The dummy can be moved to simulate many batters, whether the batter crowds the plate, or remains a great distance from the plate.

It is contemplated that one dummy 10 can be expanded to grow as a child grows, so one dummy is usable by one child for many years. In accordance with the present invention, the dummy can be made in several sizes, or more expansion areas may be included so one manufactured apparatus is capable of use by a wide range of people.

It will therefore be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

I claim:

1. Apparatus for use in practicing pitching a baseball, said apparatus including a mat, a simulation of a home plate on said mat, and a dummy selectively attachable to said mat adjacent to said home plate, said dummy being inflatable and shaped to simulate a batter, said dummy including at least one accordion folded section for selectively shortening and lengthening said dummy, and means for fixing the length of said accordion folded section.

2. Apparatus as claimed in claim 1, wherein said dummy defines a plurality of compartments individually inflatable, and including a plurality of valve means, each valve means of said plurality of valve means being located to inflate one compartment of said plurality of compartments.

3. Apparatus as claimed in claim 1, wherein said means for fixing the length of said accordion folded section comprises a strip fixed to said dummy above said accordion folded section, and means for temporarily fixing said strip to said dummy below said accordion folded section.

4. Apparatus as claimed in claim 1, wherein said mat includes first fastening means thereon, and the bottom of said dummy includes second fastening means thereon, said first and second fastening means being interengageable for attaching said dummy to said mat.

5. Apparatus as claimed in claim 4, wherein said first and second fastening means comprise hooks and loops of hook and loop fasteners.

6. Apparatus as claimed in claim 1, and further including means for fixing said mat to the ground comprising a plurality of stakes, said mat defining a plurality of holes therein, each hole of said plurality of holes receiving one stake of said plurality of said stakes, each said stake including a head for holding said mat with respect to said stake.

7. Apparatus as claimed in claim 1, wherein said dummy includes indicating means for defining a strike zone, said indicating means comprising a first marker for defining an upper limit to said strike zone and a second marker for defining a lower limit to said strike zone.

8. Apparatus as claimed in claim 7, wherein said first marker and said second marker comprise colored stripes on said dummy.

* * * * *